US011004639B2

(12) United States Patent
Wu

(10) Patent No.: US 11,004,639 B2
(45) Date of Patent: May 11, 2021

(54) ARMATURE OF RELAY

(71) Applicant: SONG CHUAN PRECISION CO., LTD., New Taipei (TW)

(72) Inventor: Sung-Jen Wu, New Taipei (TW)

(73) Assignee: SONG CHU AN PRECISION CO., LTD., New Taipei (TW)

( * ) Notice: Subject to any disclaimer, the term of this patent is extended or adjusted under 35 U.S.C. 154(b) by 233 days.

(21) Appl. No.: 16/166,341

(22) Filed: Oct. 22, 2018

(65) Prior Publication Data

US 2020/0126745 A1 Apr. 23, 2020

(51) Int. Cl.

| | |
|---|---|
| ***H01H 1/12*** | (2006.01) |
| ***H01H 50/24*** | (2006.01) |
| ***H01H 50/64*** | (2006.01) |
| *H01H 50/14* | (2006.01) |
| *H01H 51/29* | (2006.01) |

(52) U.S. Cl.

CPC ..... *H01H 50/24* (2013.01); *H01H 50/643* (2013.01); *H01H 50/14* (2013.01); *H01H 51/29* (2013.01)

(58) Field of Classification Search

CPC ..... H01H 50/24; H01H 50/643

See application file for complete search history.

(56) References Cited

U.S. PATENT DOCUMENTS

| | | | | |
|---|---|---|---|---|
| 4,837,538 | A * | 6/1989 | Dittmann | H01H 50/042 335/128 |
| 5,216,397 | A * | 6/1993 | Matsuoka | H01H 50/02 335/78 |
| 5,396,204 | A * | 3/1995 | Matsuoka | H01H 50/04 335/78 |
| 5,874,875 | A * | 2/1999 | Kobayashi | B23K 11/11 335/128 |
| 5,894,253 | A * | 4/1999 | Ichikawa | H01H 50/042 335/78 |
| 6,483,407 | B1 * | 11/2002 | Matsuda | H01H 50/02 335/202 |
| 7,106,154 | B2 * | 9/2006 | Takano | H01H 50/026 335/128 |
| 8,228,143 | B2 * | 7/2012 | Takano | H01H 50/047 335/78 |
| 10,199,193 | B2 * | 2/2019 | Ito | H01H 50/321 |
| 2002/0036556 | A1 * | 3/2002 | Matsuda | H01H 50/12 335/78 |

* cited by examiner

*Primary Examiner* — Alexander Talpalatski

(57) ABSTRACT

A relay includes a case and a coil unit is located in the case. Multiple first legs each have the first end thereof connected to the coil unit, and the second end thereof extending beyond the case. A second leg has the first end thereof located in the case and forms a contact, and the second end of the second leg extends beyond the case. A third leg includes an upright section and a transverse section which extends from the upright section and located in the case. The upright section has one end thereof extending beyond the case. An armature has a connection section connected to the transverse section, and a main section located beneath the contact. The connection section increases conductive area and flexibility of the armature in the case.

9 Claims, 13 Drawing Sheets

ARMATURE OF RELAY

BACKGROUND OF THE INVENTION

1. Fields of the Invention

The present invention relates to a relay, and more particularly, to an armature of a relay and the armature is bent to have a loner main section which has better flexibility within the relay.

2. Descriptions of Related Art

The conventional relay includes an input circuit and an output circuit so as to use small current to control large current to protect the electric devices. The room in relays is limited so that the armature installed in the relay has a limited space to pivot. Conventionally, one end of the armature is welded to the leg of the relay so that the range that the armature is limited. Another problem is that if a larger current is needed to be controlled, a shorter armature may cause overflow and burning.

The present invention is intended to provide an armature of a relay, and the purpose is to increase the main section of the armature to successfully use small current to control large current.

SUMMARY OF THE INVENTION

The purpose of the present invention is to make the armature in the relay be more flexible and stable within the room of the case of the relay, such that the armature is cable to work under high current.

The present invention relates to a relay and comprises a case having a room defined therein, and a coil unit is located in the room. Multiple first legs each have the first end thereof connected to the coil unit, and the second end of each first leg extends beyond the case. A second leg has the first end thereof located in the room and forms a contact, and the second end of the second leg extends beyond the case. A third leg has an upright section and a transverse section. The transverse section extends from one side of the first end of the upright section and is located in the case. The upright section has the second end thereof extending beyond the case. An armature has a connection section and a main section, wherein the connection section is connected to the transverse section, and a bent portion is formed between the connection section and the main section. The distal end of the main section is located beneath the contact. The connection section increases conductive area and flexibility of the armature in the room.

Preferably, the main section includes a first portion, a second portion and a neck which is formed between the first and second portions. The first portion extends from the bent portion. The first portion is longer than each of the connection section, the second portion and the neck. The first portion and the second portion are located on two planes, and the neck is inclinedly connected between the first portion and the second portion.

Preferably, an extension portion is formed between the bent portion and the first portion. The extension portion is an L-shaped portion.

Preferably, the first portion includes an elongate hole defined axially therethrough.

Preferably, the first portion includes a recess defined in each of two sides thereof.

Preferably, the first portion includes a wing extending from each of two sides thereof.

Preferably, the transverse section of the third leg extends from the top end of the upright section. The upright section and the transverse section are located on a common plane, with an angle of 180 degrees formed between the upright section and the transverse section.

Preferably, the transverse section of the third leg extends from one side of the upright section, with an angle of 90 degrees is formed between the upright section and the transverse section.

Preferably, the case includes a body and a housing which is mounted to the body. The room is formed in the body. The coil unit includes a coil seat, a conductive plate and a driving member. The first ends of the multiple first legs are connected to two ends of the coil set. The first end of the conductive plate is located between the coils seat and the armature. The second end of the conductive plate is resiliently contact the coils seat, or is removed from the coils seat. The driving member is connected to the first end of the conductive plate. The conductive plate pivots when the conductive plate is magnetically attracted by the coil seat, and the driving member controls the armature to pivot. The main section of the armature contacts the contact when the armature pivots. A circuit is formed between the coil unit, the first legs, the second leg, the third leg and the armature.

The advantages of the present invention are that the third leg has an upright section and a transverse section. The armature includes the conductive area so as to work under high current. The length of the armature is longer than the conventional armature because of the bent portion. The bent portion is located close to the transverse section of the third leg so that the armature is more flexible to pivot so as to stably and accurately turn on or turn off the circuit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
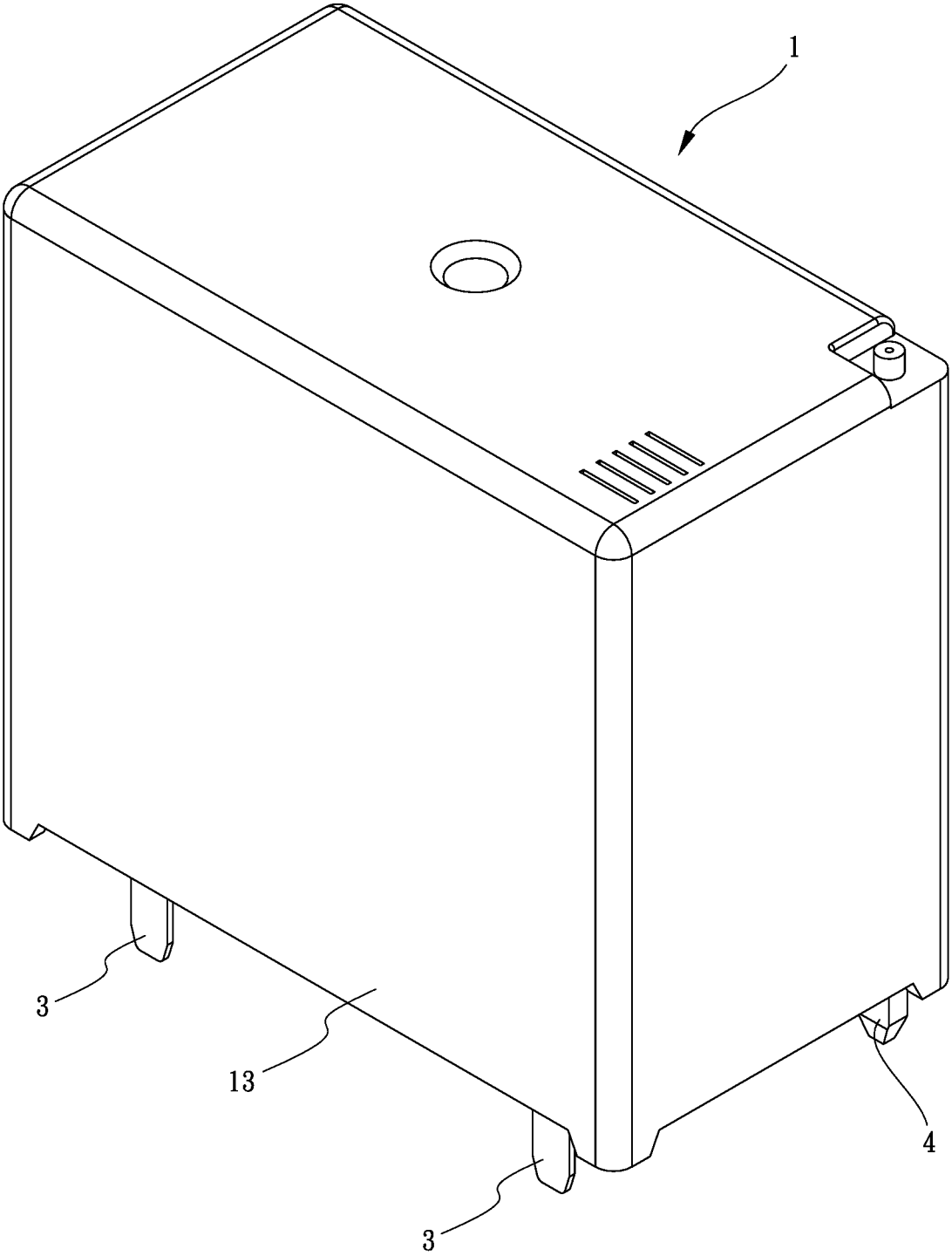
FIG. 1 is a perspective view to show the relay of the present invention.
Figure 2:
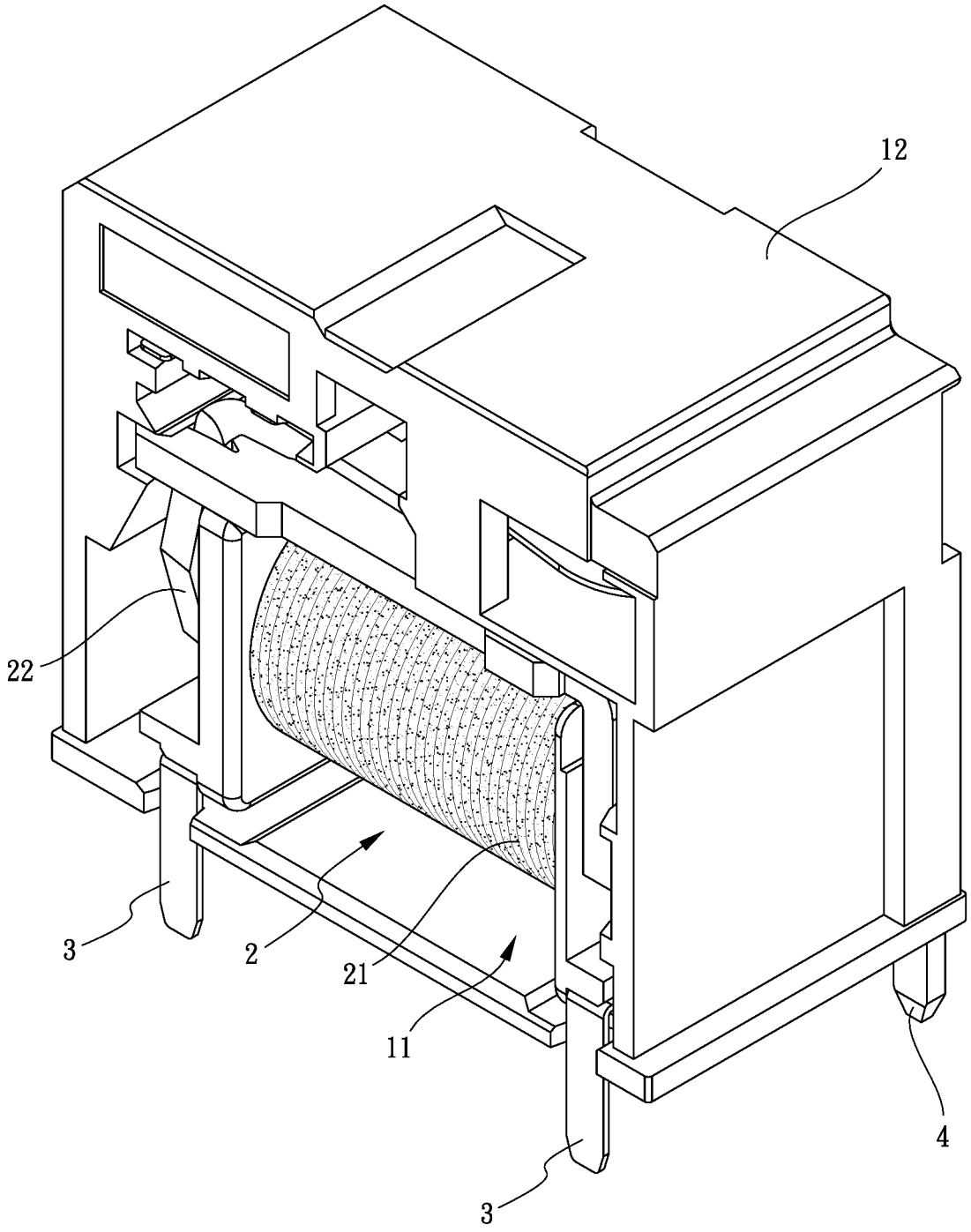
FIG. 2 shows the relay of the present invention without the housing.
Figure 3:
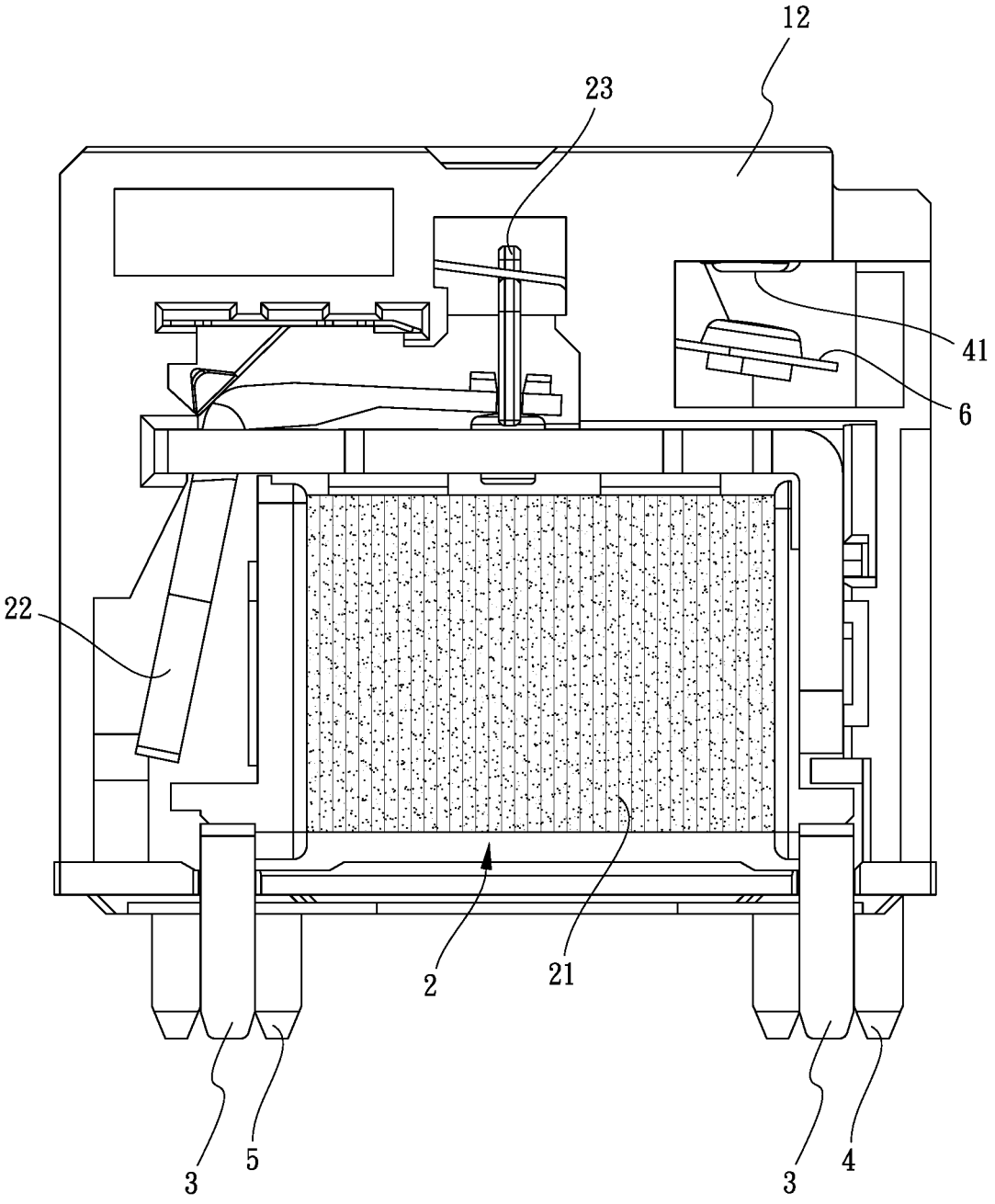
FIG. 3 is a plan view of the relay of the present invention.
Figure 4:
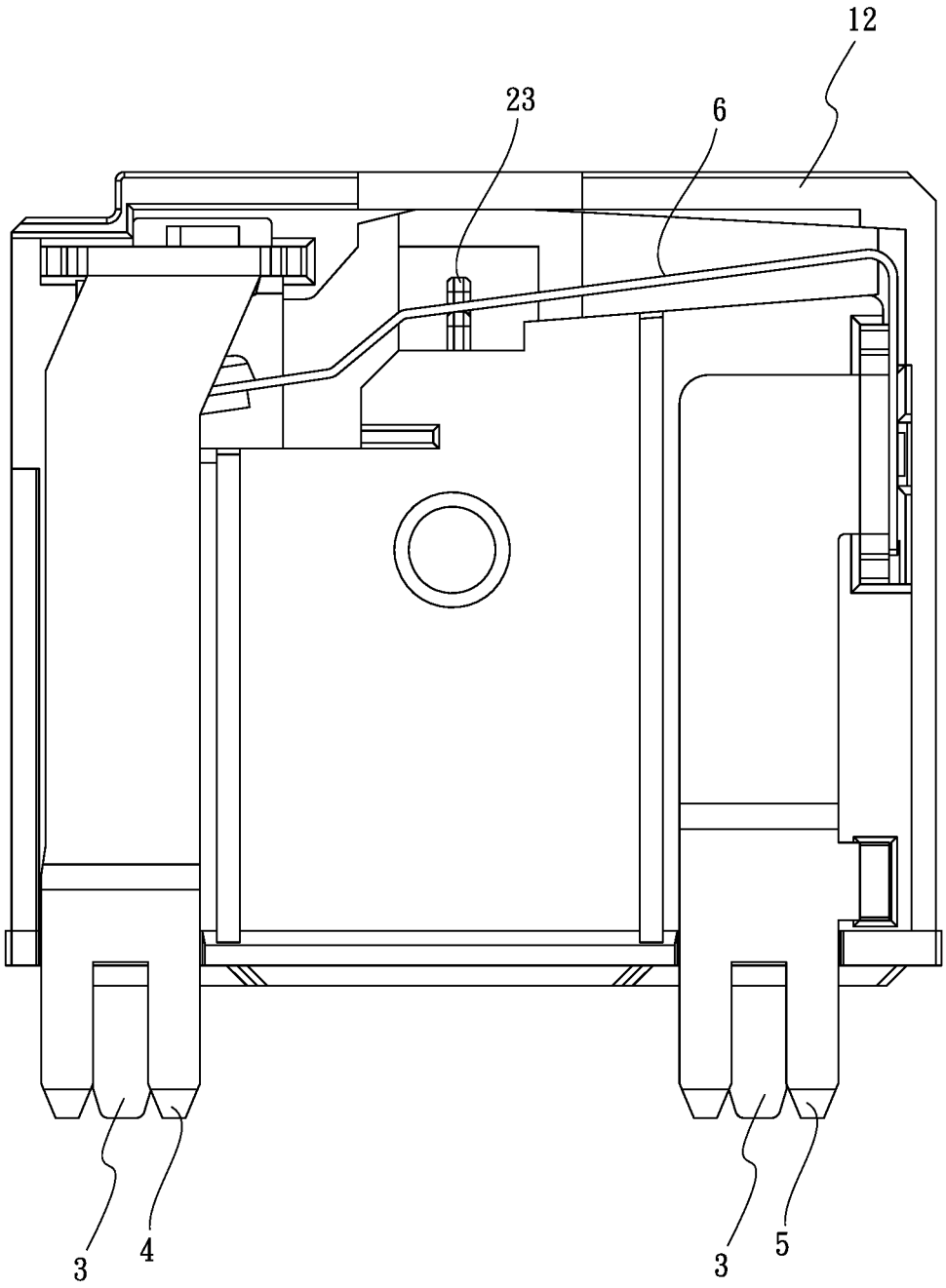
FIG. 4 shows another plan view of the relay of the present invention.

Referring to FIGS. 1 to 5 and 5A, the relay of the present invention comprises a case 1 which is a rectangular case and has a room 11 defined therein. Specifically, the case 1 includes a body 12 and a housing 13 which is mounted to the body 12. The room 11 is formed in the body 12. A coil unit 2 is located in the room 11. Multiple first legs 3 each have the first end thereof connected to the coil unit 2, and the second end of each first leg 3 extending beyond the case 1. The second ends of all of the first legs 3 are located on the first side of the case 1. A second leg 4 has the first end thereof located in the room 11 and forms a contact 41, and the second end of the second leg 4 extends beyond the case 1 and located one the second side of the case 1. A third leg 5 includes an upright section 51 and a transverse section 52, wherein the transverse section 52 extends from one side of the first end of the upright section 51 and is located in the case 1. The upright section 51 has the second end thereof extending beyond the case 1.

An armature 6 is located in the room 11 and includes a connection section 61 and a main section 62. The connection section 61 is riveted to the transverse section 52. A bent portion 62 is formed between the connection section 61 and the main section 62. The distal end of the main section 62 located beneath the contact 41. A gap is formed between the transverse section 52 and the bent portion 63. The connection section 61 is configured to increase conductive area and flexibility of the armature 6 in the room 11. In other words, after the coil unit 2 is activated, the armature 6 is more flexible than the conventional armature such that the contact between the armature 6 and the contact 41 is more accurate.

The armature 6 of the present invention includes the bent portion 63 and the connection section 61, and both of which are not provided for the conventional armature 6. As shown in FIG. 5A, the length of the main section 62 is defined as "A", and the length of the connection section 61 is defined as "B", while the conventional armature only includes the "A" so that the flexibility of the conventional armature is restricted by the position where the rivets are located. The armature 6 of the present invention includes the connection section 61 so that the total length of the armature 6 is "A"+"B". Besides, the bent portion 63 is located close to the transverse section 52, so that the main section 62 is more flexible and the range that the main section 62 pivots is wider so as to accurately contact the contact 41 of the second leg 4. Therefore, the relay can be made smaller while the armature 6 works as expected.

Figure 5:
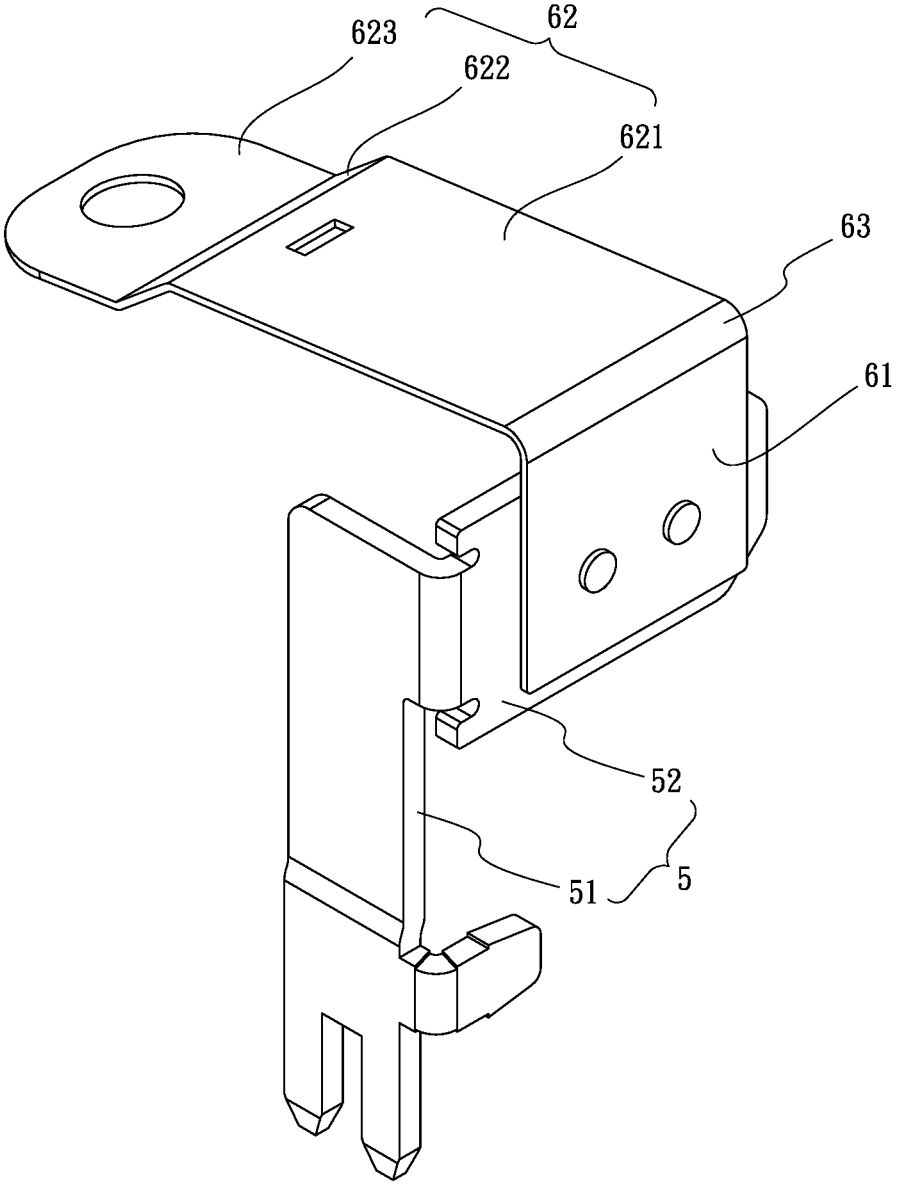
FIG. 5 shows the first embodiment of the armature connected to the third leg of the relay of the present invention.
Figure 5A:
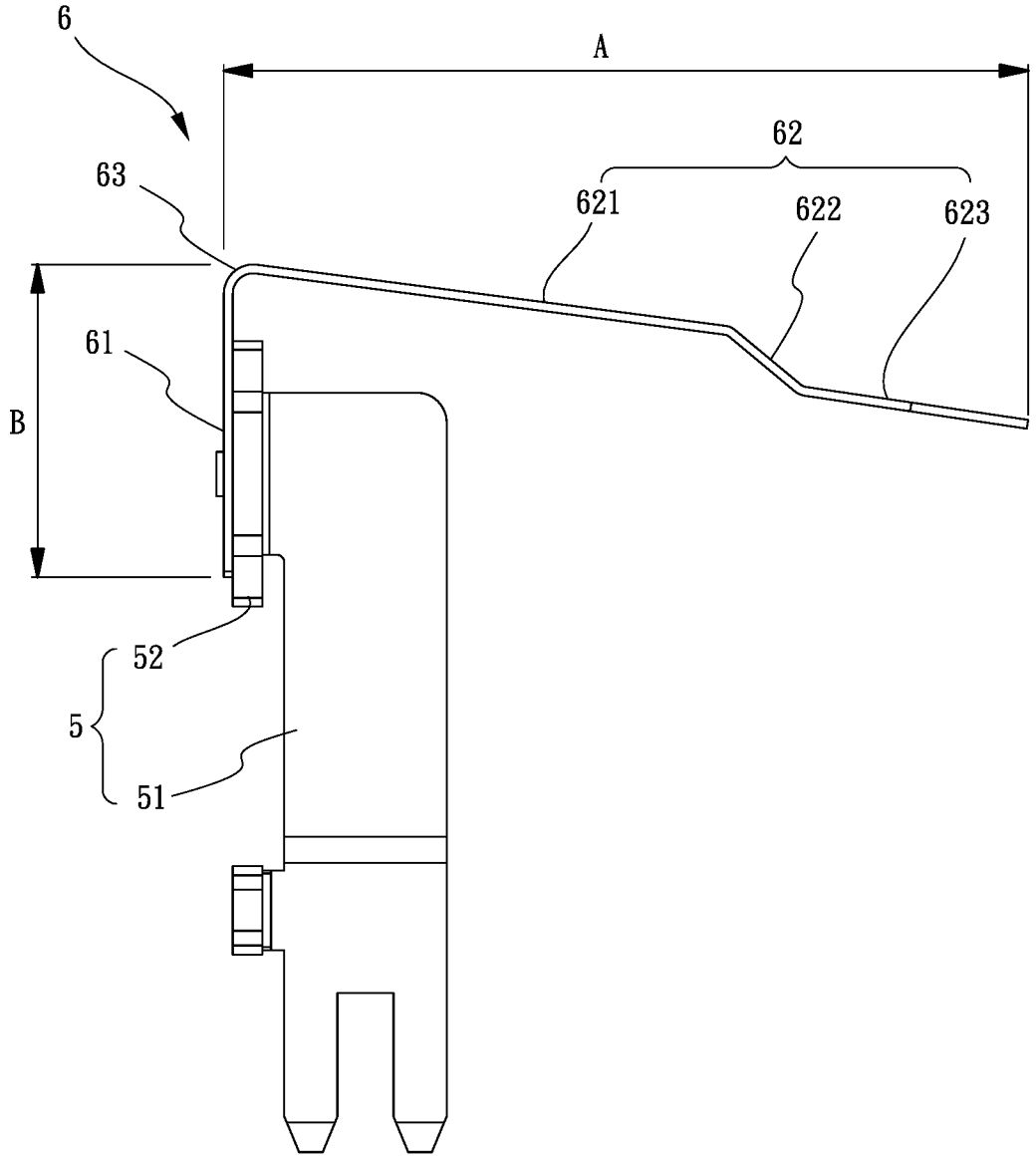
FIG. 5A is a side view of FIG. 6.

As shown in FIG. 5, the main section 62 includes a first portion 621, a second portion 623 and a neck 622 which is formed between the first and second portions 621, 623. The first portion 621 extends from the bent portion 63. The length of the first portion 621 is longer than the length of each of the connection section 61, the second portion 623 and the neck 622. The first portion 621 and the second portion 623 are located on two planes, and the neck 622 is inclinedly connected between the first portion 621 and the second portion 623.

Figure 6:
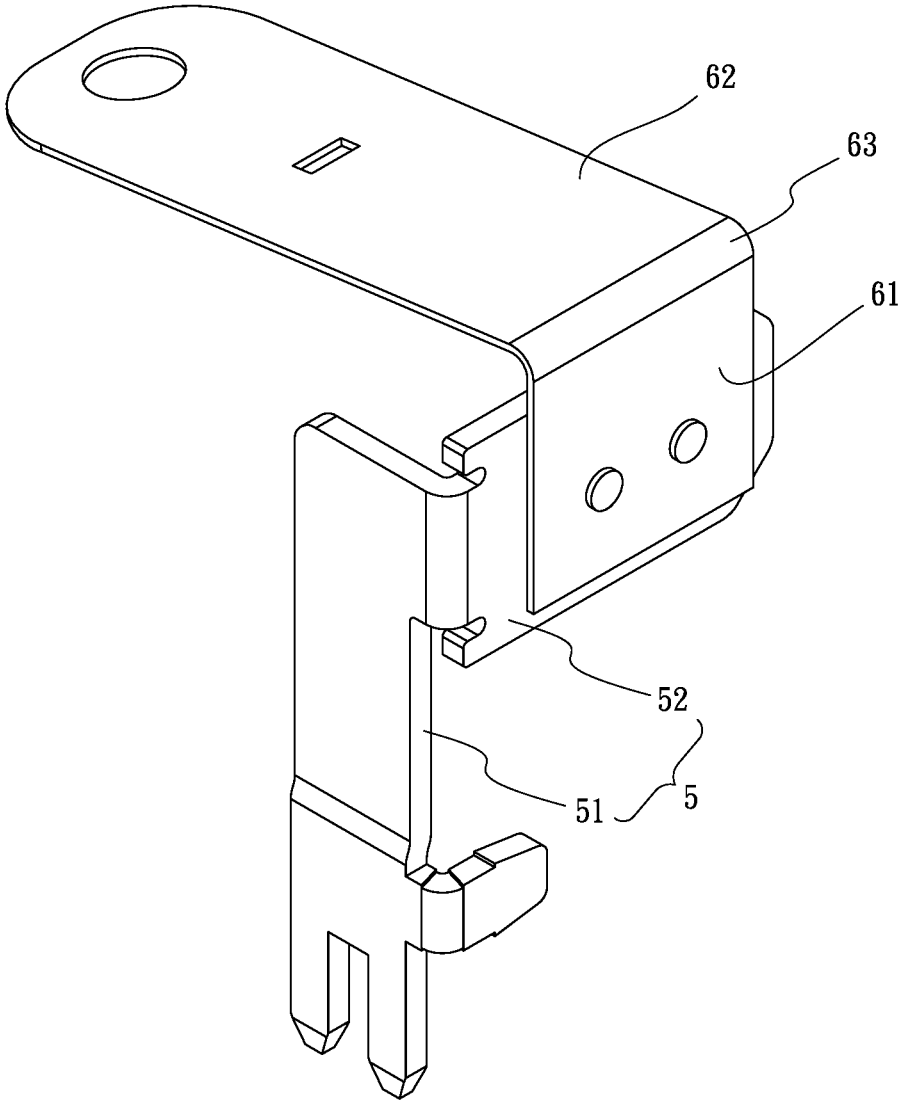
FIG. 6 shows the second embodiment of the armature connected to the third leg of the relay of the present invention.

FIG. 6 shows that the first portion 621 is a straight plate.

Figure 7:
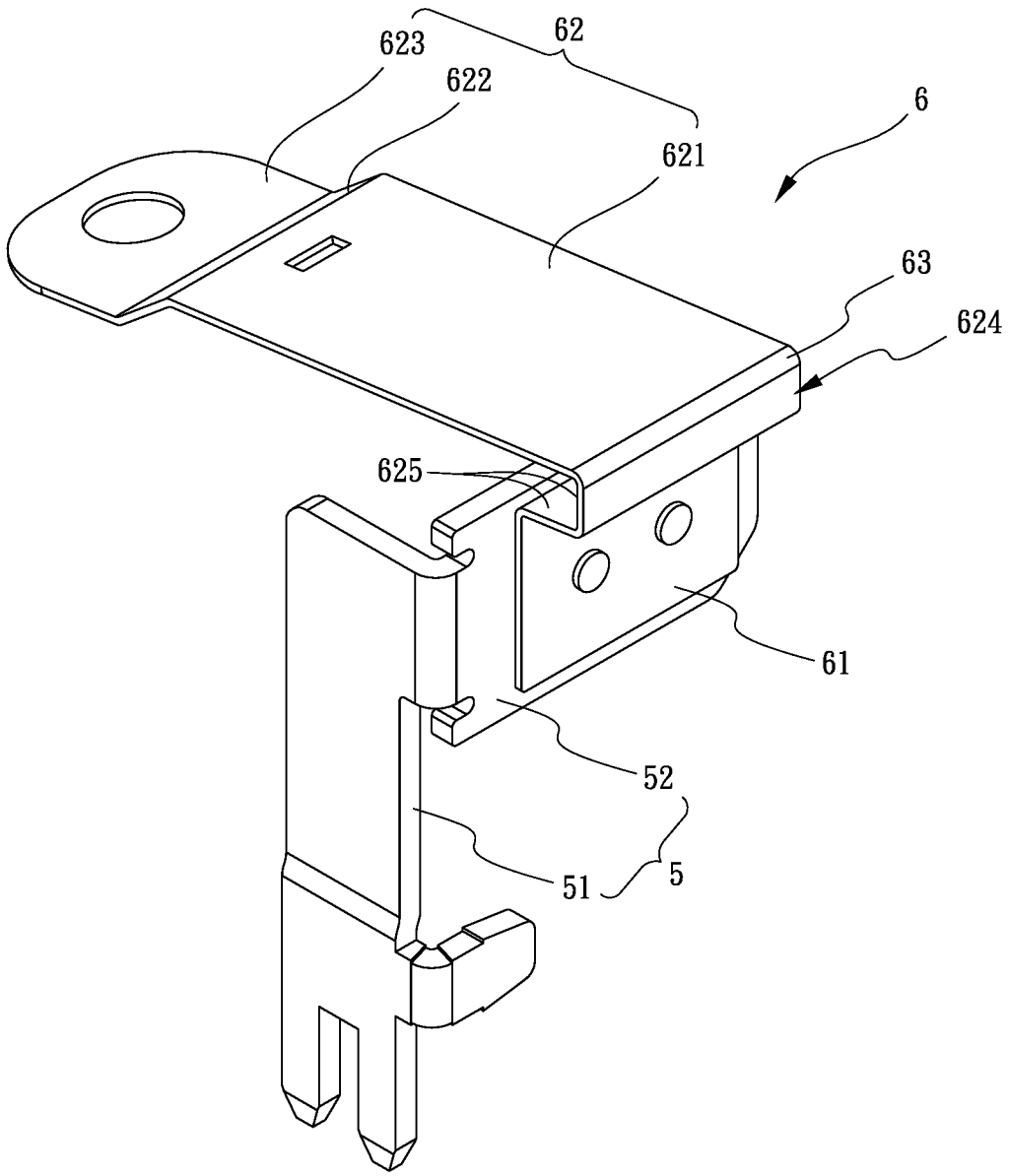
FIG. 7 shows the third embodiment of the armature connected to the third leg of the relay of the present invention.

FIG. 7 shows that an extension portion 624 is formed between the bent portion 63 and the connection portion 611. The extension portion 624 is an L-shaped portion which includes a vertical portion 624 and a horizontal portion 625 which is integrally and perpendicularly formed with the vertical portion 624.

Figure 8:
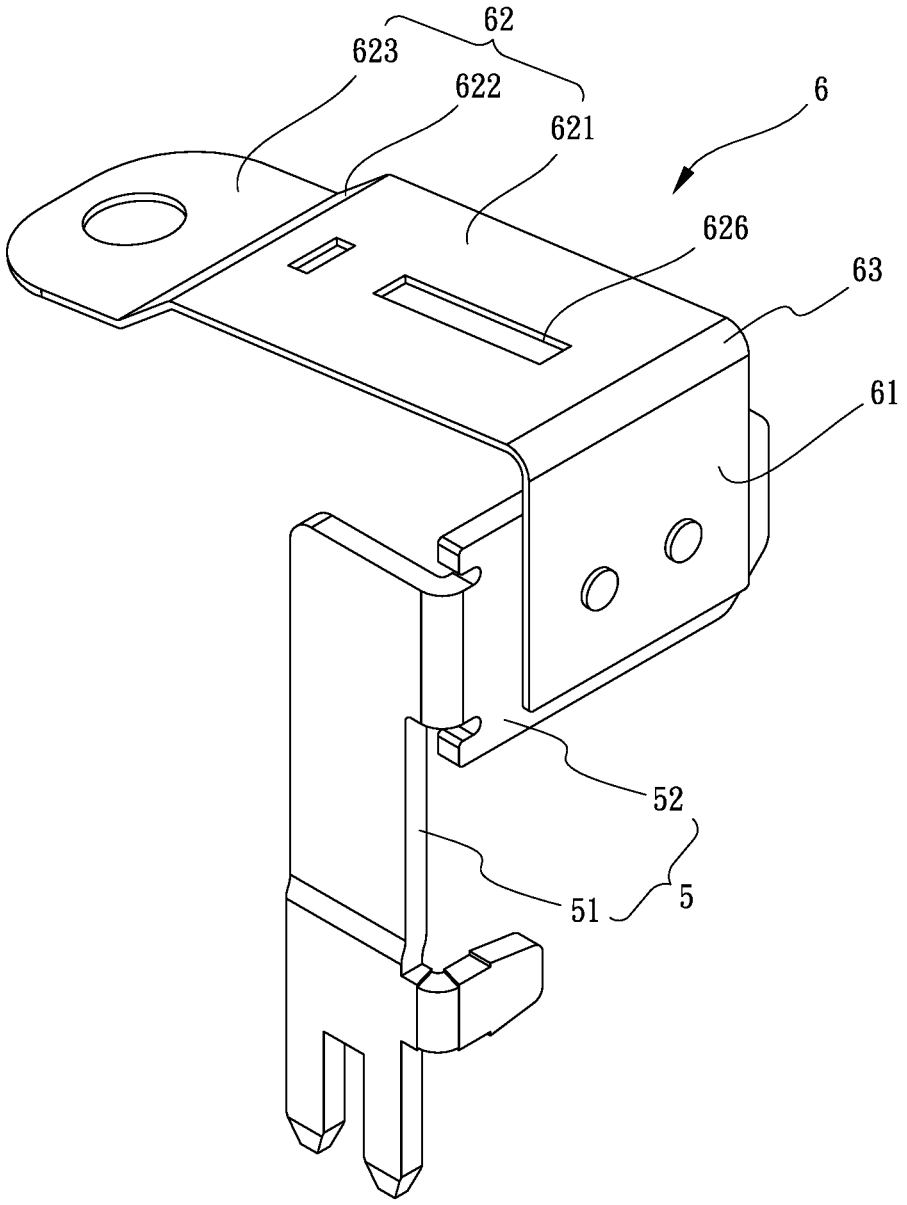
FIG. 8 shows the fourth embodiment of the armature connected to the third leg of the relay of the present invention.
Figure 9:
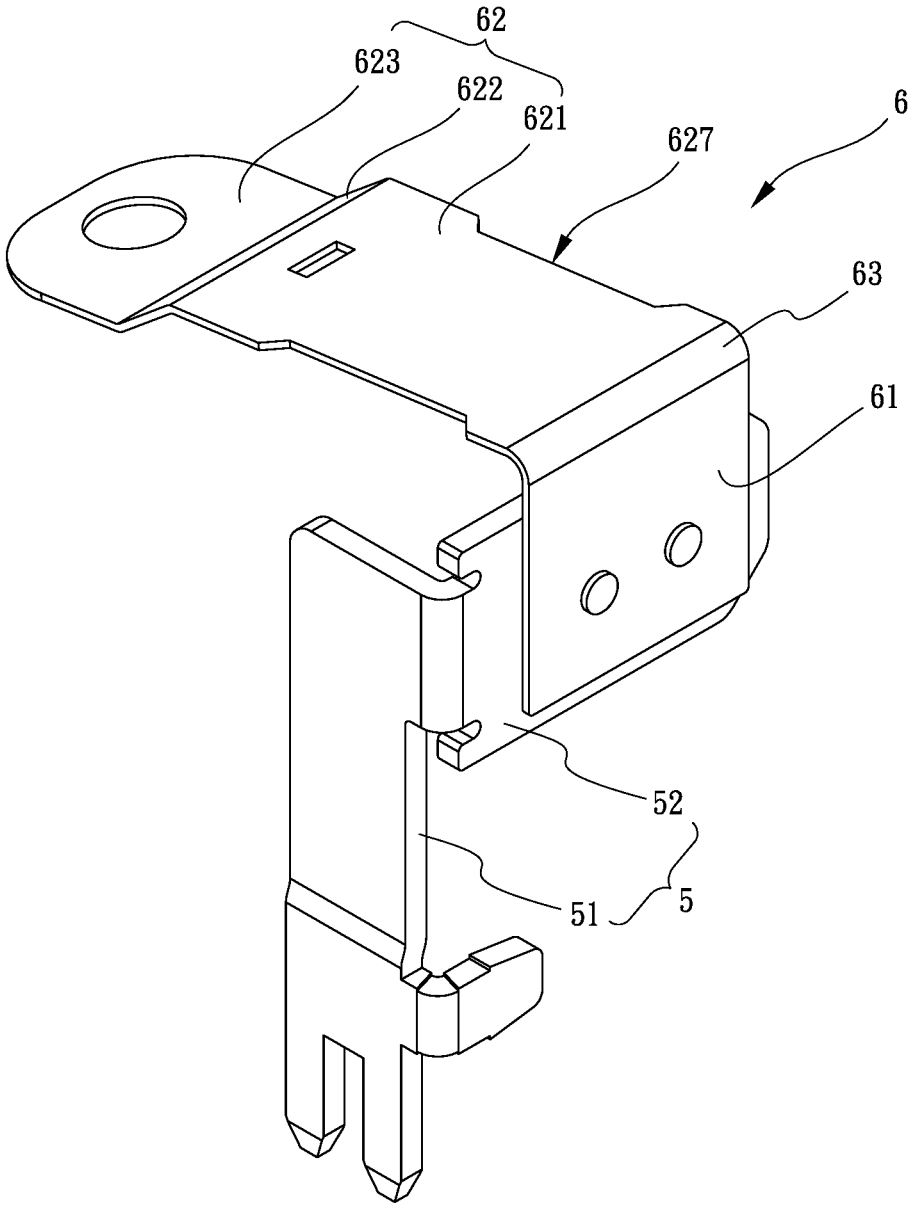
FIG. 9 shows the fifth embodiment of the armature connected to the third leg of the relay of the present invention.

FIG. 8 shows that the first portion 621 includes an elongate hole 626 defined axially therethrough for better heat dissipation. FIG. 9 shows that the first portion 621 includes a recess 627 defined in each of two sides thereof so as to save manufacturing cost while does not affect its function.

FIG. 9 shows that the first portion 621 includes a wing 628 extending from each of two sides thereof to further increase area of conductivity.

Figure 10:
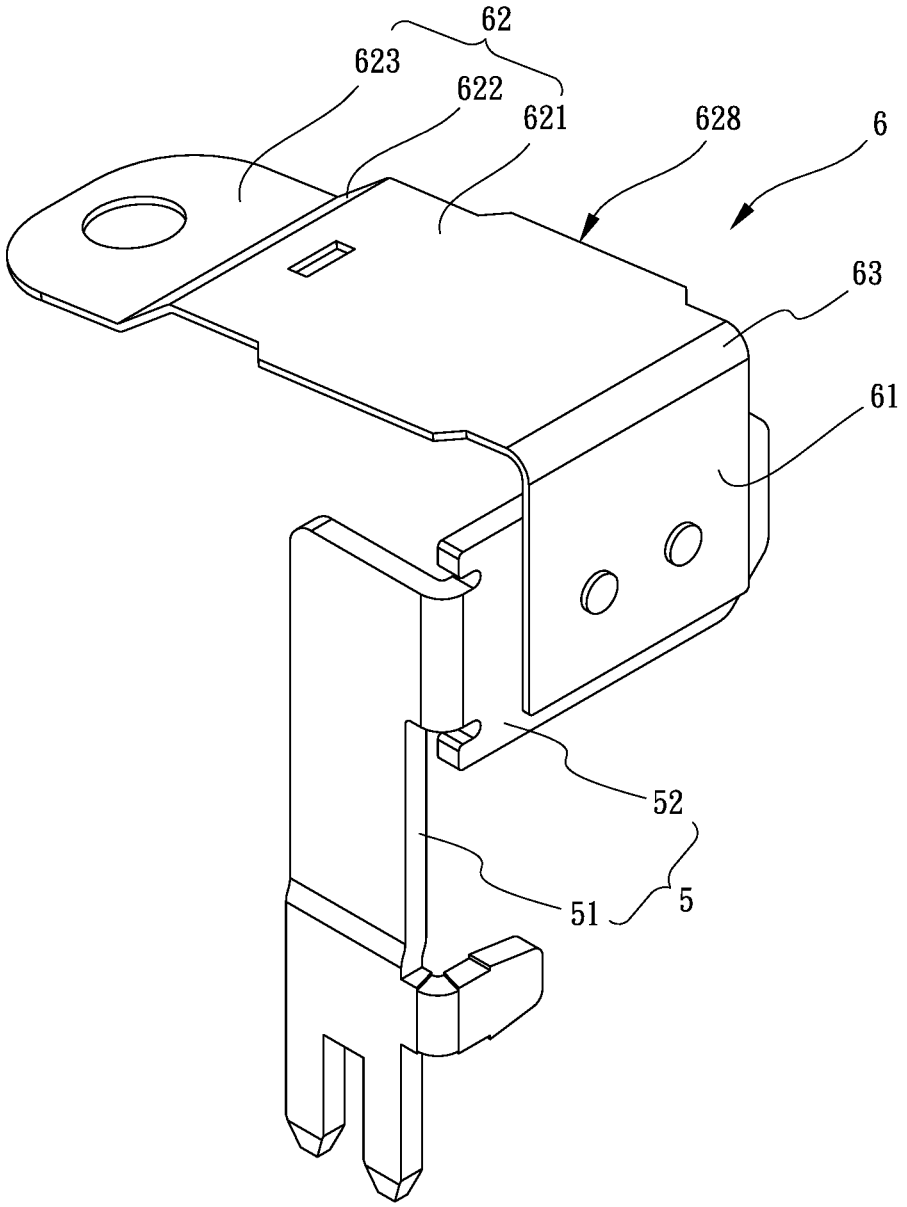
FIG. 10 shows the sixth embodiment of the armature connected to the third leg of the relay of the present invention.

FIG. 10 shows that the transverse section 52 of the third leg 5 extends from one side of the upright section 51. An angle of 90 degrees is formed between the upright section 51 and the transverse section 52.

Figure 11:
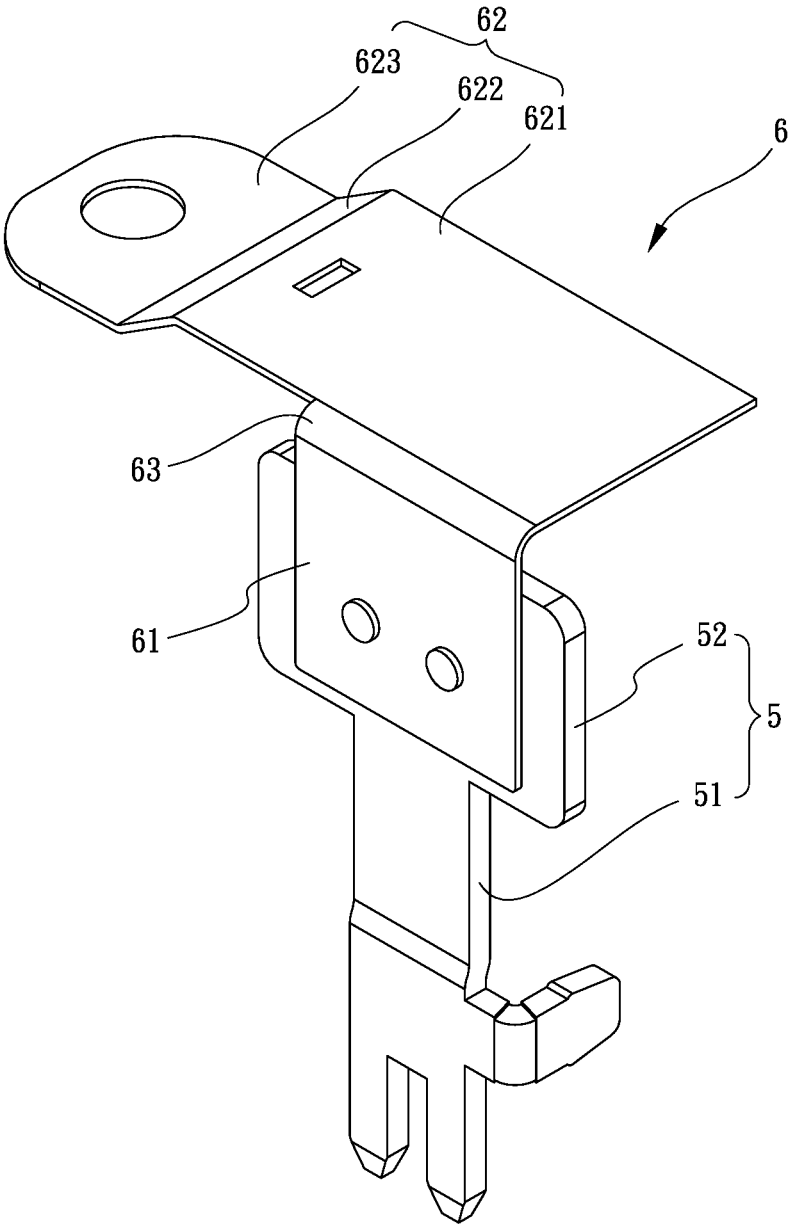
FIG. 11 shows another embodiment of the third leg that is connected to the armature.
Figure 12:
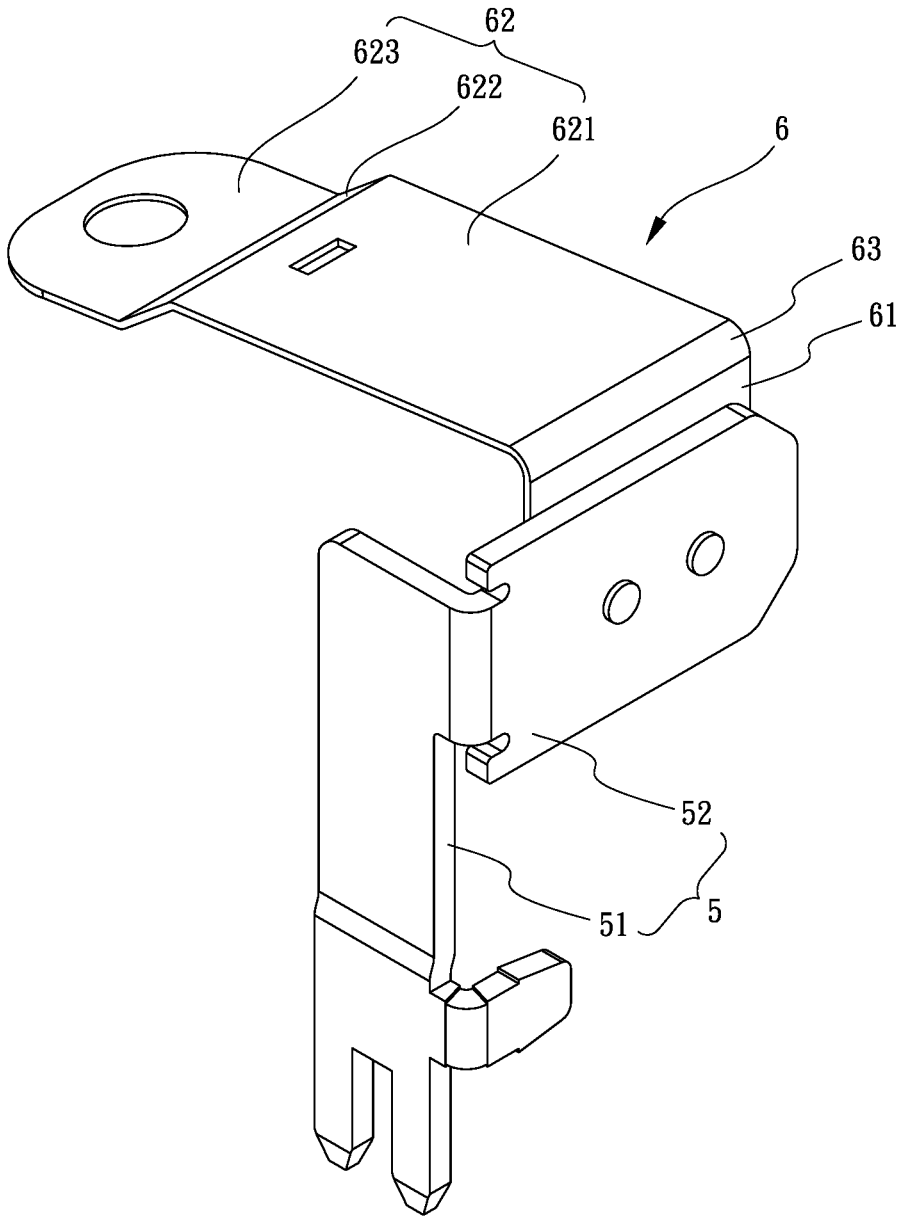
FIG. 12 shows yet another embodiment of the third leg that is connected to the armature.

FIG. 11 shows that the transverse section 52 of the third leg 5 extends from a top end of the upright section 51. The upright section 51 and the transverse section 52 are located on a common plane. An angle of 180 degrees is formed between the upright section 51 and the transverse section 52.

In the previous embodiments, the connection section 61 of the armature 6 is riveted to outside of the transverse section 52. FIG. 13 shows that the connection section 61 of the armature 6 is riveted to inside of the transverse section 52.

The coil unit 2 includes a coil seat 21, a conductive plate 22 and a driving member 23. The first ends of the multiple first legs 3 are connected to two ends of the coil set 21. The first end of the conductive plate 22 is located between the coils seat 21 and the armature 6, and the second end of the conductive plate 22 is resiliently contact the coils seat 21 or is removed from the coils seat 21. The driving member 23 is connected to the first end of the conductive plate 22. The conductive plate 22 pivots when the conductive plate 22 is magnetically attracted by the coil seat 21, and the driving member 23 controls the armature 6 to pivot. The main section 62 of the armature 6 contacts the contact 41 when the armature 6 pivots, so that a circuit is formed between the coil unit 2, the first legs 3, the second leg 4, the third leg 5 and the armature 6.

While we have shown and described the embodiment in accordance with the present invention, it should be clear to those skilled in the art that further embodiments may be made without departing from the scope of the present invention.

What is claimed is:

1. A relay comprising:

a case having a room defined therein;

a coil unit located in the room;

multiple first legs each having a first end thereof connected to the coil unit, and a second end of each first leg extending beyond the case;

a second leg having a first end thereof located in the room and forming a contact, a second end of the second leg extending beyond the case;

a third leg having an upright section and a transverse section, the transverse section extending from one side of a first end of the upright section and located in the case, the upright section having a second end thereof extending beyond the case, and an armature having a connection section and a main section, the connection section connected to the transverse section, a bent portion formed between the connection section and the main section, the main section including a first portion, a second portion and a neck which is formed between the first and second portions, the first portion extending from the bent portion, a length of the first portion being longer than a length of each of the connection section, the second portion and the neck, the first portion and the second portion being located on two planes, the neck inclinedly connected between the first portion and the second portion, a distal end of the main section located beneath the contact, the connection section configured to increase conductive area and flexibility of the armature in the room.

2. The relay as claimed in claim 1, wherein an extension portion is formed between the bent portion and the connection section, the extension portion is an L-shaped portion.

3. The relay as claimed in claim 1, wherein the first portion includes an elongate hole defined axially therethrough.

4. The relay as claimed in claim 1, wherein the first portion includes a recess defined in each of two sides thereof.

5. The relay as claimed in claim 1, wherein the first portion includes a wing extending from each of two sides thereof.

6. The relay as claimed in claim 1, wherein the transverse section of the third leg extends from a top end of the upright section, the upright section and the transverse section are located on a common plane, an angle of 180 degrees is formed between the upright section and the transverse section.

7. The relay as claimed in claim 1, wherein the transverse section of the third leg extends from one side of the upright section, an angle of 90 degrees is formed between the upright section and the transverse section.

8. The relay as claimed in claim 1, wherein the case includes a body and a housing which is mounted to the body, the room is formed in the body, the coil unit includes a coil seat, a conductive plate and a driving member, the first ends of the multiple first legs are connected to two ends of the coil set, a first end of the conductive plate is located between the coils seat and the armature, a second end of the conductive plate is resiliently contact the coils seat or is removed from the coils seat, the driving member is connected to the first end of the conductive plate, the conductive plate pivots when the conductive plate is magnetically attracted by the coil seat, and the driving member controls the armature to pivot, the main section of the armature contacts the contact when the armature pivots, a circuit is formed between the coil unit, the first legs, the second leg, the third leg and the armature.

9. The relay as claimed in claim 7, wherein the case 1 includes a body and a housing which is mounted to the body, the room is formed in the body, the coil unit includes a coil seat, a conductive plate and a driving member, the first ends of the multiple first legs are connected to two ends of the coil set, a first end of the conductive plate is located between the coils seat and the armature, a second end of the conductive plate is resiliently contact the coils seat or is removed from the coils seat, the driving member is connected to the first end of the conductive plate, the conductive plate pivots when the conductive plate is magnetically attracted by the coil seat, and the driving member controls the armature to pivot, the main section of the armature contacts the contact when the armature pivots, a circuit is formed between the coil unit, the first legs, the second leg, the third leg and the armature.

* * * * *